US007954739B2

(12) United States Patent
Shin-Ya

(10) Patent No.: US 7,954,739 B2
(45) Date of Patent: Jun. 7, 2011

(54) GARBAGE DISPOSAL APPARATUS

(76) Inventor: Kouichi Shin-Ya, Osaka (JP)

( * ) Notice: Subject to any disclaimer, the term of this patent is extended or adjusted under 35 U.S.C. 154(b) by 0 days.

(21) Appl. No.: 12/838,649

(22) Filed: Jul. 19, 2010

(65) Prior Publication Data

US 2010/0276526 A1 Nov. 4, 2010

Related U.S. Application Data

(63) Continuation of application No. PCT/JP2009/050943, filed on Jan. 22, 2009.

(30) Foreign Application Priority Data

Jan. 23, 2008 (JP) ..... 2008-012994

(51) Int. Cl.
*B02C 19/00* (2006.01)

(52) U.S. Cl. ..... 241/46.013; 241/100; 241/101.2

(58) Field of Classification Search ..... 241/101.2, 241/46.012–46.017, 46.06, 100
See application file for complete search history.

(56) References Cited

FOREIGN PATENT DOCUMENTS

| | | |
|---|---|---|
| JP | 04-145962 | 5/1992 |
| JP | 08-299832 | 11/1996 |
| JP | 11-130202 | 5/1999 |
| JP | 2002-320943 | 11/2002 |
| JP | 2003-290743 | 10/2003 |
| JP | 2004-160295 | 6/2004 |

OTHER PUBLICATIONS

International Search Report issued Feb. 17, 2009 in International (PCT) Application No. PCT/JP2009/050943.

*Primary Examiner* — Mark Rosenbaum
(74) *Attorney, Agent, or Firm* — Wenderoth, Lind & Ponack, L.L.P.

(57) ABSTRACT

A garbage disposal apparatus includes a shredding device for shredding garbage put in through a drain opening of a sink and a connecting member, a transverse conveying device for conveying the garbage shredded by the shredding device in a transverse direction, a dehydrating device into which the shredded garbage conveyed through the transverse conveying device is introduced and that is for dehydrating the shredded garbage while conveying the shredded garbage upward, a drying device into which the shredded garbage discharged through the dehydrating device is supplied via a chute and that is for drying the shredded garbage while rotating, and a garbage receptacle disposed under the drying device so as to be able to be pulled out, and the shredded garbage dried and reduced in volume by the drying device drops from the rotating drying device and is collected in the garbage receptacle.

6 Claims, 5 Drawing Sheets

GARBAGE DISPOSAL APPARATUS

This application is a Continuation of International Application No. PCT/JP2009/050943, filed Jan. 22, 2009.

BACKGROUND OF THE INVENTION

I. Technical Field

The present invention relates to a garbage disposal apparatus for disposing of garbage from a kitchen or the like in, for example, a household.

II. Description of the Related Art

Conventionally, garbage disposal apparatuses for disposing of garbage generated in, for example, household or commercial kitchens include a garbage disposal apparatus in which, as disclosed in JP 2003-290743A and JP 2004-160295A, garbage put into the apparatus together with tap water through a drain opening formed in a kitchen sink is ground by a disposer, and then the ground garbage is introduced into a lower portion of a dehydration screen by means of tap water, dehydrated while being conveyed upward by a conveying screw provided in the dehydration screen, and discharged into a treatment unit from an outlet formed in an upper end portion of the dehydration screen and there undergoes microbial treatment.

SUMMARY OF THE INVENTION

Since a garbage disposal apparatus as described above requires tap water when conveying the ground garbage to the dehydration screen, the consumption of tap water increases and the ground garbage discharged into the treatment unit is likely to contain an excessive amount of water. Accordingly, there is a problem in that the load on the treatment unit increases and hence impedes the smooth progress of microbial treatment. Moreover, among garbage generated from a kitchen or the like, for example, shellfish shells, big bones of fish, chicken, and the like, and crab shells are difficult for some disposers to grind and therefore need be sorted beforehand, and the sorting operation is troublesome. For example, improper sorting of garbage generated during cooking or cleaning up after a meal or accidental putting in of a disposable wooden chopstick, a small branch of an ornamental plant, or the like causes a breakdown, and in this manner, trouble is likely to occur.

The present invention has been achieved in view of the problems as described above, and it is an object thereof to provide a garbage disposal apparatus that is capable of reliably shredding most types of garbage and reducing the volume thereof without the use of tap water nor the need for sorting.

The present invention includes a shredding means or device that is communicable with a drain opening of a sink via a connecting member, and is for shredding garbage put in through the drain opening of the sink and the connecting member; a transverse conveying means or device that is provided under the shredding means, and is for conveying the shredded garbage in a transverse direction; a dehydrating means or device into which the shredded garbage conveyed through the transverse conveying means is introduced, and that is for dehydrating the shredded garbage while conveying the shredded garbage upward; a drying means or device into which the shredded garbage discharged through the dehydrating means is supplied via a chute, and that is for drying the shredded garbage while rotating; and a garbage receptacle that is disposed under the drying means so as to be able to be pulled out, wherein the shredded garbage dried and reduced in volume by the drying means drops from the rotating drying means and is collected in the garbage receptacle.

According to the present invention, garbage put in through the drain opening of the sink drops down to the shredding means via the connecting member and is there shredded into small pieces, and then drops down to the transverse conveying means. After that, the shredded garbage is conveyed in the transverse direction by the transverse conveying means and supplied to the dehydrating means. The shredded garbage supplied to the dehydrating means is conveyed upward and discharged from an upper end portion toward the chute. At this time, excess water is separated from the shredded garbage by a dehydrating effect and drained to the outside. The shredded garbage discharged from the dehydrating means is supplied to the drying means via the chute and dried by the drying means as the drying means rotates. Upon being dried and reduced in volume, the shredded garbage drops from the rotating drying means and is collected in the garbage receptacle.

Consequently, the volume of garbage can be significantly reduced, and time and effort required to discard the garbage can be saved. Furthermore, even shellfish shells, big bones, and the like, which are conventionally difficult for some disposers to grind, can be shredded, so that the inconvenience of sorting the garbage is eliminated. In addition, since tap water is not necessary, the consumption of tap water does not increase, and moreover, there is no need to dispose of garbage containing an excessive amount of water.

In the present invention, it is preferable that a garbage strainer that doubles as a starting switch through the drain opening of the sink is detachably provided in the connecting member. With this configuration, it is possible to reliably prevent the shredding means from operating when garbage is being put into the connecting member through the drain opening of the sink, or garbage from being put into the connecting member in a state in which the shredding means is operating, and therefore, garbage can be put in safely.

In the present invention, it is preferable that the shredding means includes a shredder and a retaining blade that is disposed above the shredder and is for pressing down garbage from above. With this configuration, root crops such as radish and fruits such as apples are prevented from jumping around on the shredder and thus can be reliably shredded.

In the present invention, it is preferable that the transverse conveying means includes a semi-cylindrical conveying trough having a plurality of drainage holes formed in a peripheral wall thereof and a rotatable transverse conveying screw installed in the conveying trough. With this configuration, tap water flowing in through the drain opening of the sink can be drained to the outside through the drainage holes of the conveying trough rather than being supplied to the dehydrating means through the transverse conveying means. Therefore, kitchen work can be performed without restriction even when garbage is being disposed.

In the present invention, it is preferable that the shredding means and the transverse conveying means are driven by a single shredding motor so as to rotate in a set direction at respectively reduced speeds. With this configuration, the shredding means and the transverse conveying means can be rotatively driven by the single shredding motor, so that the cost can be reduced as compared with the case where the shredding means and the transverse conveying means are provided with separate motors, and the shredding means and the transverse conveying means can be compactly housed.

In the present invention, it is preferable that the dehydrating means is provided with a water level sensor for detecting that a water level in a dehydration screen has risen to a certain level or more. With this configuration, if a large amount of water temporarily flows in and increases the water level in the dehydration screen, the water can be quickly drained to the outside of the dehydration screen by unclogging the drainage holes of the dehydration screen by positively rotating the vertical conveying screw.

In the present invention, it is preferable that a flap facing an outlet of the dehydrating means is provided in the chute so as to be able to swing on a vertical axis, and the flap is biased by a spring so as to close the outlet. With this configuration, when the shredded garbage pushed out by the dehydrating means presses against the flap with a predetermined pressure, the outlet can be opened against the biasing force of the spring, and thus, a constant amount of the shredded garbage can be reliably supplied via the chute to the drying means each time.

In the present invention, it is preferable that a fullness sensor for detecting that the garbage receptacle in which the dried shredded garbage is sequentially collected is full to capacity is provided. With this configuration, when fullness has been detected, the operation of the shredding means, the transverse conveying means, the dehydrating means, and the drying means can be stopped, and it is possible to prompt the discharge of the shredded garbage in the garbage receptacle filled to capacity from the garbage receptacle and prevent the collected shredded garbage from overflowing from the garbage receptacle.

In the present invention, it is preferable that an exhaust fan is attached to a main body casing housing the dehydrating means, the drying means, and the garbage receptacle. With this configuration, external air can be sucked into the main body casing and exhausted to the outside together with water vapor, odors, and the like building up inside the main body casing, so that it is possible to prevent odors from spreading.

According to the present invention, most types of garbage can be reliably shredded and reduced in volume without the use of tap water nor the need for sorting.

DETAILED DESCRIPTION OF THE INVENTION

Hereinafter, an embodiment of the present invention will be described based on the drawings.

Figure 1:
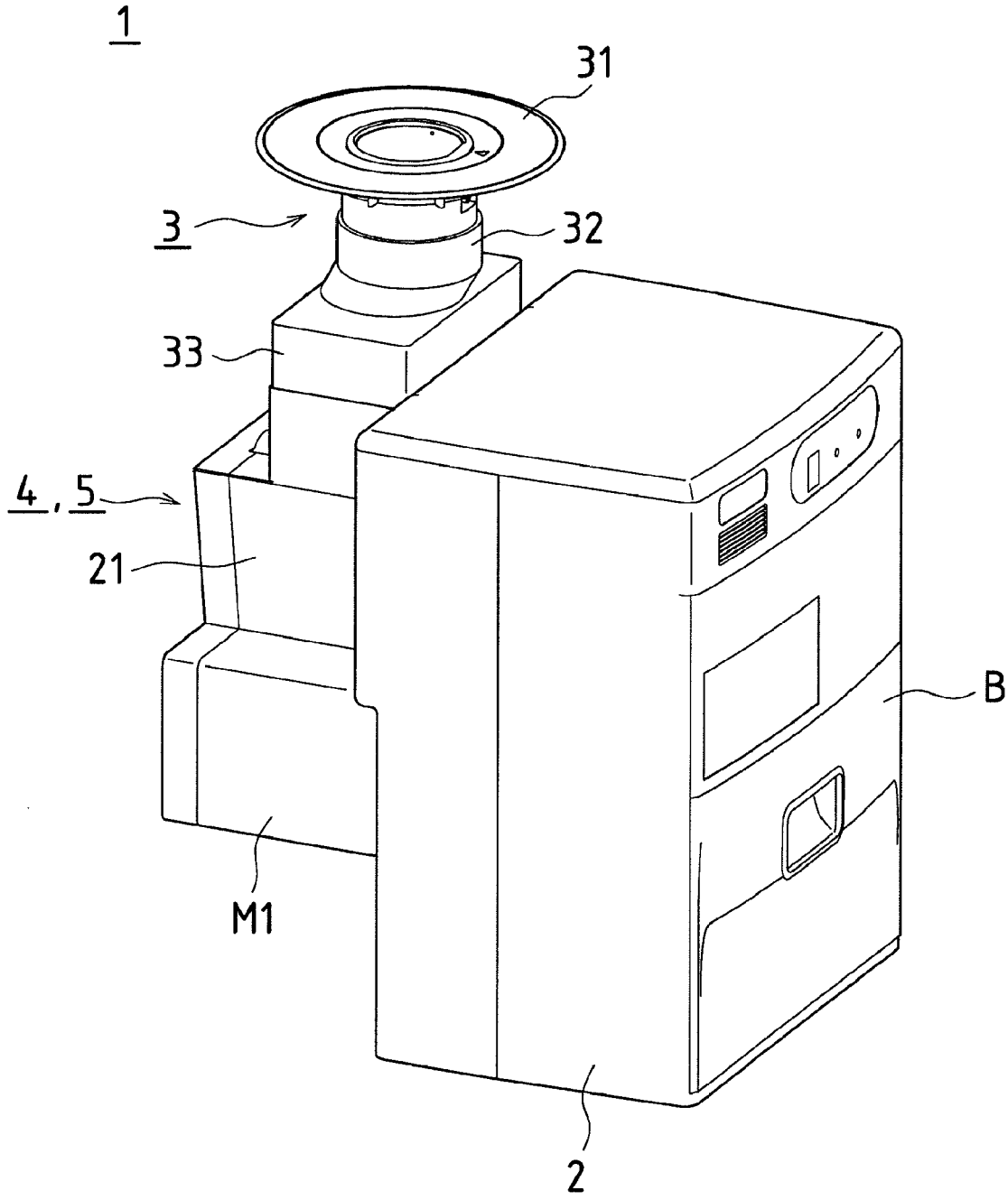
FIG. 1 is a perspective view showing an embodiment of a garbage disposal apparatus of the present invention.
Figure 2:
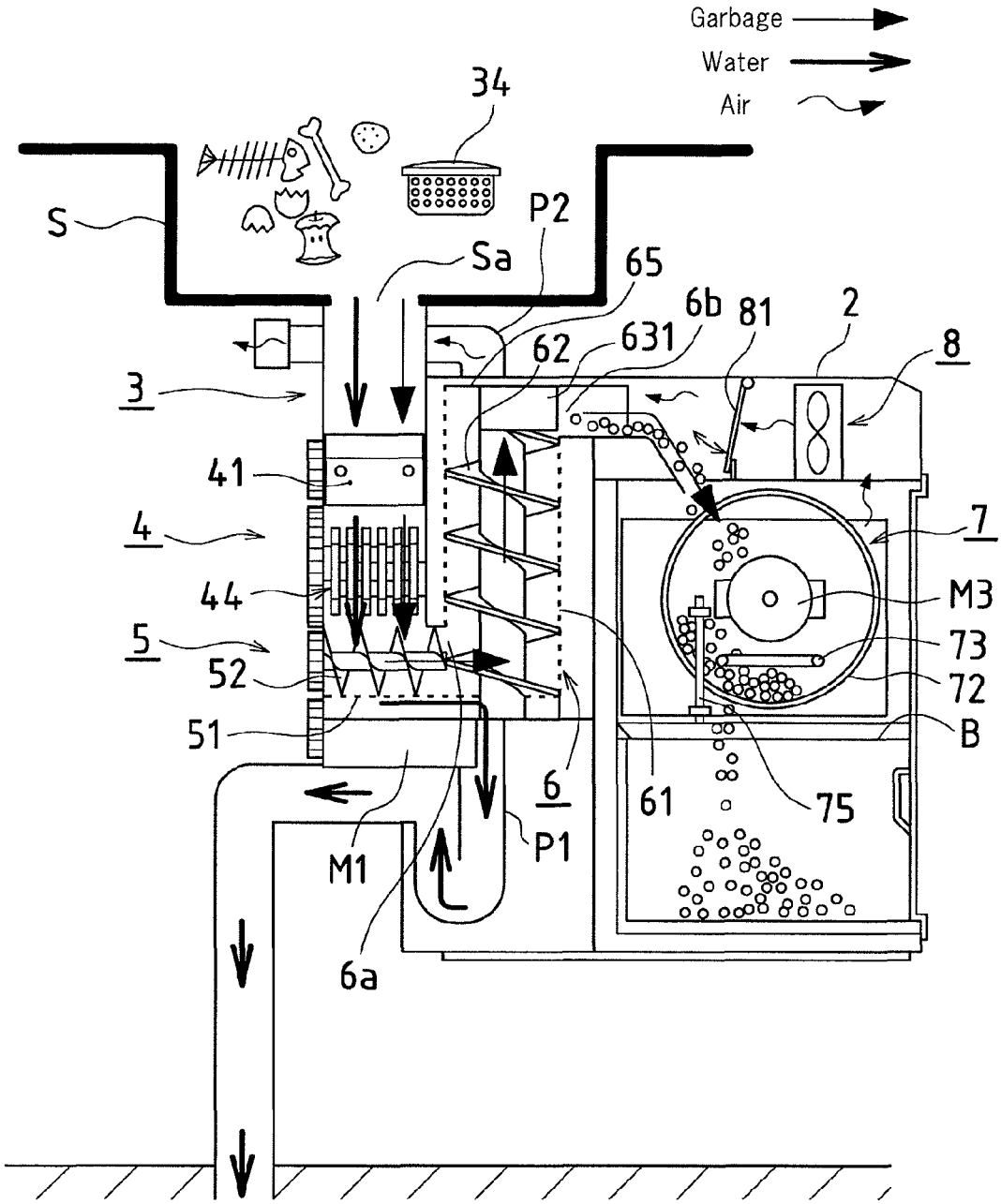
FIG. 2 is a diagram schematically showing the garbage disposal apparatus in FIG. 1.
Figure 3:
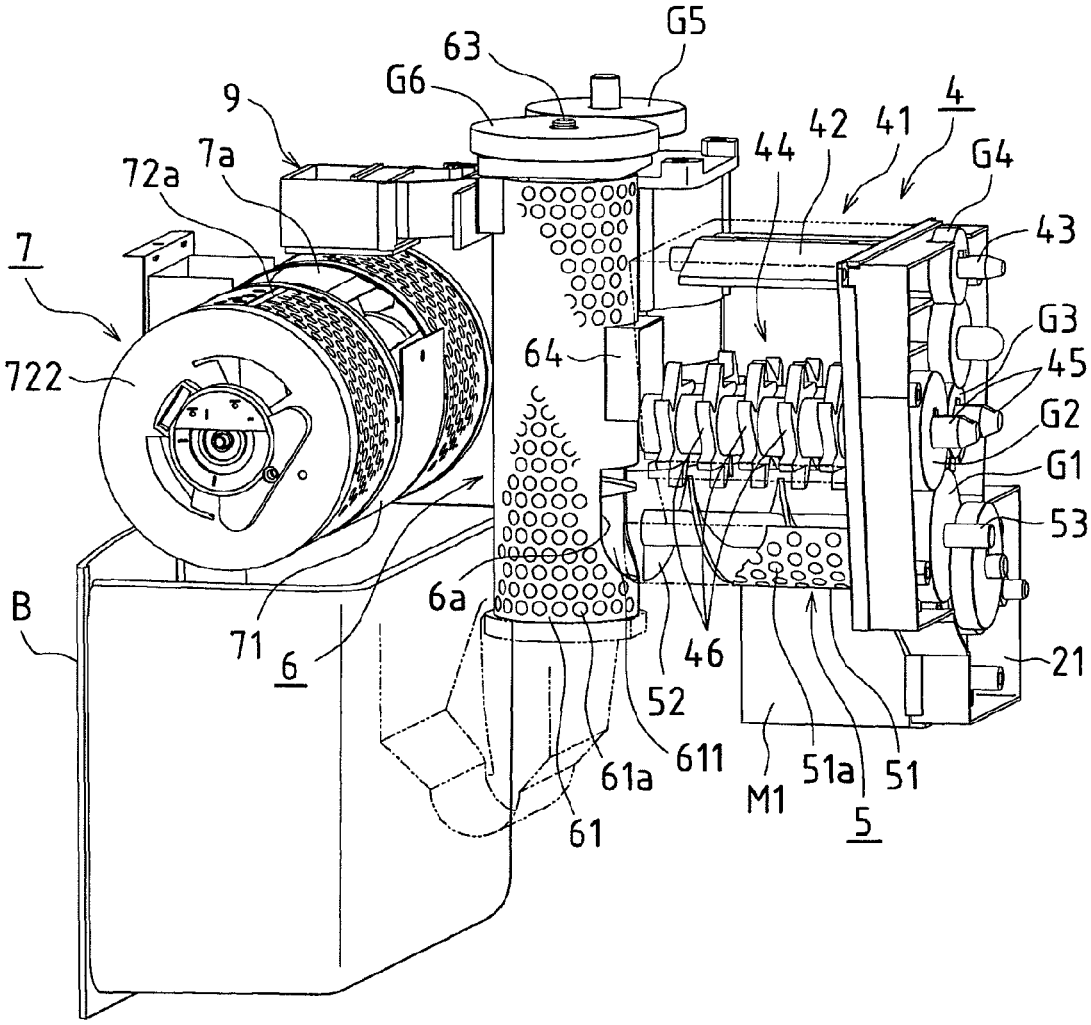
FIG. 3 is a partially omitted perspective view showing a shredding means, a transverse conveying means, and a drying means as well as a garbage receptacle of the garbage disposal apparatus in FIG. 1.

FIGS. 1 to 3 show an embodiment of a garbage disposal apparatus 1 of the present invention. This garbage disposal apparatus 1 is configured of a connecting member 3 that can be connected to a drain opening Sa formed in a kitchen sink S (see FIG. 2) in a household or the like, a shredding means 4 provided under the connecting member 3, a transverse conveying means 5 disposed under the shredding means 4, a dehydrating means 6 provided adjacent to the transverse conveying means 5, a drying means 7 provided adjacent to the dehydrating means 6, a garbage receptacle B disposed under the drying means 7 so as to be able to be pulled out, and an exhaust fan 8. Among these, the dehydrating means 6, the drying means 7, the garbage receptacle B, and the exhaust fan 8 are disposed in a main body casing 2. Moreover, the shredding means 4 and the transverse conveying means 5 are disposed in a side casing 21 fixed to the main body casing 2, and the connecting member 3 is coupled to the side casing 21.

The connecting member 3 is formed by integrally coupling a connection box 33 that can be connected to the shredding means 4 to a tube 32 provided with a flange 31, and in a state in which a top opening of the tube 32 is aligned with the drain opening Sa of the sink S, the flange 31 is connected to a back face of the sink S via a sealant that is not shown while ensuring watertightness. Moreover, a reed switch (not shown) is provided in an upper end portion of the tube 32 so that once a garbage strainer 34 (see FIG. 2) is fitted to the tube 32 through the drain opening Sa of the sink S, the garbage disposal apparatus 1 operates for a certain period of time. That is, the garbage strainer 34 doubles as a starting switch for actuating the reed switch, and this makes it possible to reliably prevent the shredding means 4 from operating when garbage is being put into the connecting member 3 through the drain opening Sa of the sink S, or garbage from being put into the connecting member 3 in a state in which the shredding means 4 is operating, and therefore, garbage can be put in safely.

The shredding means 4 includes a rotatable retaining blade 41 and a shredder 44 provided under the retaining blade 41, and the connection box 33 of the connecting member 3 is coupled to a top opening of the side casing 21. Then, the retaining blade 41 is formed of a blade plate 42 that tapers from its center toward a leading edge in a width direction and a rotating shaft 43 provided in a central portion thereof, and this rotating shaft 43 is axially supported by the side casing 21 in a rotatable manner. Moreover, the shredder 44 includes a pair of parallel rotating shafts 45 and 45 axially supported by the side casing 21 in a rotatable manner and a plurality of plate-like shredding blades 46 each having a plurality of cutting teeth arranged at an outer circumferential edge thereof at intervals in a circumferential direction, and the shredding blades 46 are attached to each of the rotating shafts 45 at intervals in an axis direction in such a manner that each shredding blade of one shredding blade group is positioned between adjacent shredding blades 46 and 46 of the opposing shredding blade group.

Here, the rotation direction of each of the rotating shafts 45 of the shredder 44 is set so that the shredding blades 46, on an inner side where they overlap, rotate (positively rotate) in opposite directions so as to move downward from above. That is to say, garbage that has dropped down through the connecting member 3 and is supported between the shredding blades 46 and 46 is sheared and shredded into small pieces by the cutting teeth of the shredding blades 46 and 46 while passing between them, because the opposing shredding blades 46 positively rotate in a downward direction from above on the inner side where the shredding blades 46 overlap.

However, in the case where a foreign object other than garbage, for example, a metal eating utensil such as a spoon or a fork or a ceramic ware is put in and becomes jammed, control is performed so that the operation is suspended after the shredding blades are negatively rotated to a set angle. This enables quick removal of the foreign object.

Figure 5:
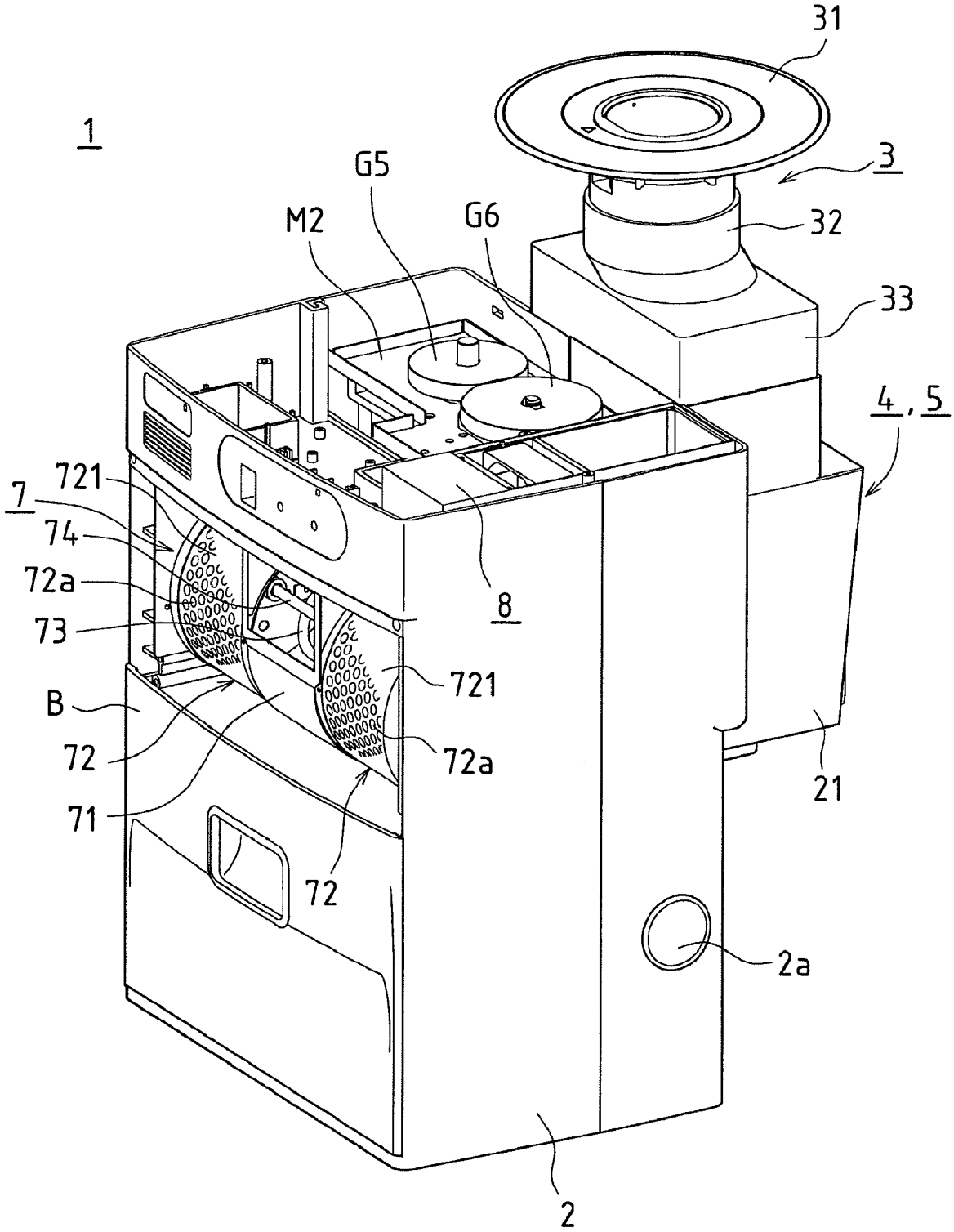
FIG. 5 is a partially omitted perspective view showing the garbage disposal apparatus in FIG. 1.

The transverse conveying means 5 includes a conveying trough 51 made of a material in which a plurality of drainage holes 51*a* are formed, such as perforated metal, by forming the material into a semi-cylindrical shape and a transverse conveying screw 52 disposed in the conveying trough 51, the conveying trough 51 is fixed to the side casing 21 under the shredding means 4, and a rotating shaft 53 of the transverse conveying screw 52 is axially supported by the side casing 21 in a rotatable manner. Then, positive rotation of the transverse conveying screw 52 allows garbage shredded by the shredding means 4 to be conveyed in a transverse direction toward the dehydrating means 6. At this time, water dripping through the drainage holes 51*a* of the conveying trough 51 is collected on a bottom wall of the side casing 21 and can be drained into a sewage system via a drain pipe P1 (see FIG. 2) connected to a drain opening 2*a* (see FIG. 5) formed in the main body casing 2. Therefore, even when tap water is let to flow during a garbage shredding process, the tap water is drained to the outside through the drainage holes 51*a* of the conveying trough 51, and thus it is possible to prevent shredded garbage containing an excessive amount of water from being directly conveyed to the dehydrating means 6.

The retaining blade 41 and the shredder 44 of the shredding means 4 and the transverse conveying means 5 are adapted to be rotated in conjunction with one another by a single shredding motor M1. Specifically, as shown in FIG. 3, a gear (not shown) fixed to an output shaft of the shredding motor M1, a gear G1 fixed to the rotating shaft 53 of the transverse conveying screw 52, gears G2 and G3 respectively fixed to the rotating shafts 45 and 45 of the shredder 44, and a gear G4 fixed to the rotating shaft 43 of the retaining blade 41 are engaged with each other successively or via a reduction gear, and thus, each of the rotating shafts 53, 45, 45, and 43 rotates in a set direction at an appropriately reduced speed with respect to the number of revolutions of the shredding motor M1.

The dehydrating means 6 includes a dehydration screen 61 made of a material in which a plurality of dehydration holes 61*a* are formed, such as perforated metal, by forming the material into a cylindrical shape and a vertical conveying screw 62 (see FIG. 2) rotatably housed in the dehydration screen 61, and is disposed in the main body casing 2 in an upright state adjacent to the transverse conveying means 5. Then, a rotating shaft 63 of the vertical conveying screw 62 is axially supported by the main body casing 2 in a rotatable manner so as to be coaxial with the dehydration screen 61. Moreover, an inlet 6*a* corresponding to the conveying trough 51 of the transverse conveying means 5 is formed in a lower portion of the dehydration screen 61, and an outlet 6*b* toward the drying means 7 side is formed in an upper end portion thereof.

Here, a peripheral leading edge of the vertical conveying screw 62 is set so as to make sliding contact with an inner circumferential surface of the dehydration screen 61. Moreover, a guide 611 (see FIG. 3) is provided on a peripheral edge of an approximately lower half portion of the inlet 6*a* of the dehydration screen 61, and an end of the conveying trough 51 of the transverse conveying means 5 is supported by this guide 611. Furthermore, a top opening of the dehydration screen 61 is closed by a lid 65.

Meanwhile, as shown in FIG. 3, a protruding portion 631 having an inverted V-shape when viewed from above is integrally provided at an upper end portion of the rotating shaft 63 of the vertical conveying screw 62, and an edge of this protruding portion 631 is adapted to make sliding contact with an inner circumferential surface of an upper end of the dehydration screen 61. Therefore, when the vertical conveying screw 62 rotates, the protruding portion 631 makes sliding contact with the inner circumferential surface of the upper end of the dehydration screen 61, and thus, shredded garbage that has been conveyed upward can be forcibly pushed out through the outlet 6*b* by the protruding portion 631.

Figure 4:
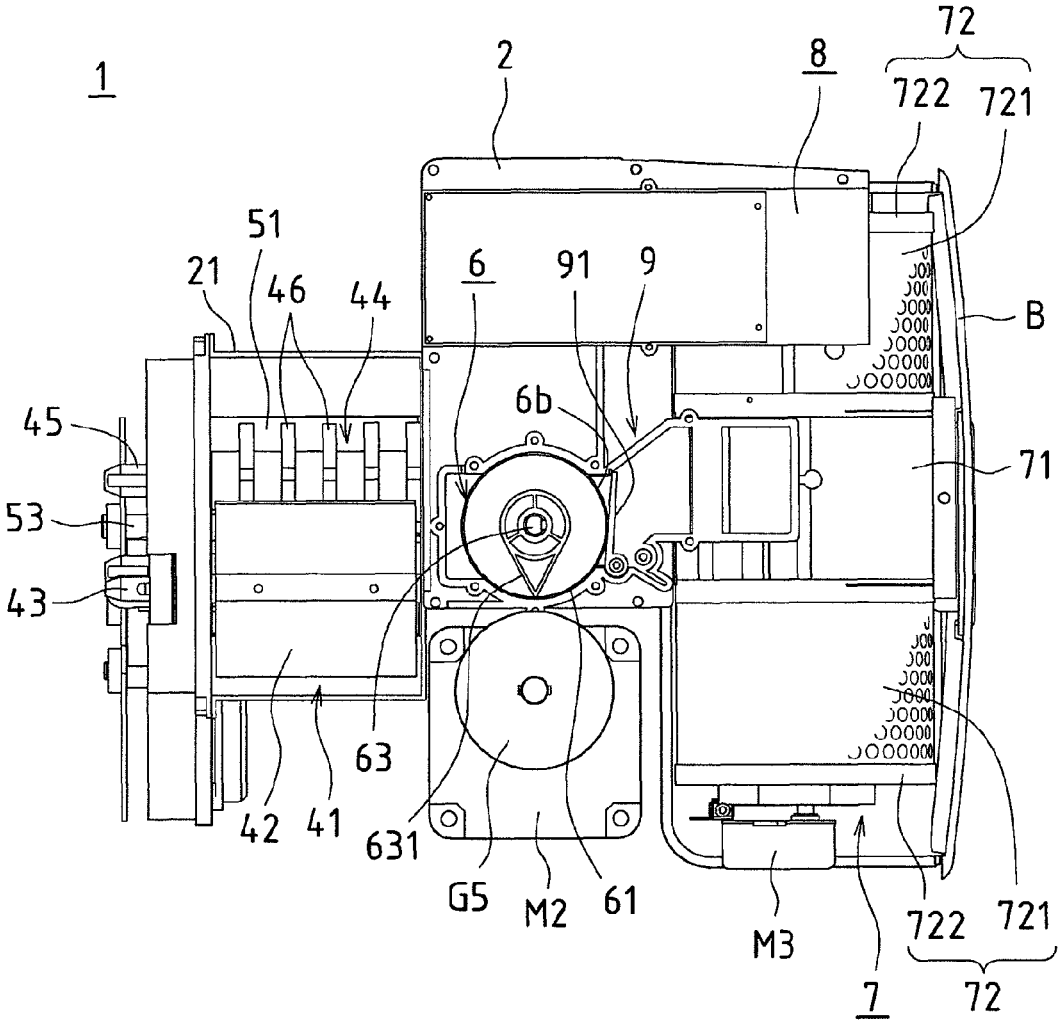
FIG. 4 is a partially omitted plan view showing the garbage disposal apparatus in FIG. 1.

Furthermore, a conveying motor M2 is provided in the main body casing 2 in a position adjacent to the dehydrating means 6, and a driven gear G6 provided at an upper end of the rotating shaft 63 of the vertical conveying screw 62 is engaged with a driving gear G5 provided on a conveying motor output shaft. Then, when the conveying motor is driven to positively rotate, that is, when the rotating shaft 63 of the vertical conveying screw 62 rotates in a counterclockwise direction in FIG. 4, shredded garbage that has been introduced into the lower portion of the dehydration screen 61 through the inlet 6*a* by the transverse conveying means 5 can be conveyed upward, and at that time, water contained in the shredded garbage can be separated by a dehydrating effect due to compression and discharged to the outside through the dehydration holes 61*a* together with drain water dripping from the conveying trough 51 of the transverse conveying means 5.

Moreover, the dehydration screen 61 of the dehydrating means 6 is provided with a water level sensor 64 (see FIG. 3). This water level sensor 64 detects that water flowing into the dehydration screen 61 through the drain opening Sa of the sink S has reached a predetermined water level, and is fitted into and integrally fixed to a cutout formed in the dehydration screen 61 so that its detecting portion is located inwardly and the leading edge of the vertical conveying screw 62 makes sliding contact with the detecting portion. Thus, in the case where a large amount of water, for example, dishwater after washing dishes in the sink or the like filled with water flows in through the drain opening Sa of the sink S in a situation in which the dehydration holes 61*a* of the dehydration screen 61 are clogged with used tea leaves, rice, or the like, even though excess water that cannot be drained by the drainage holes 51*a* of the conveying trough 51 of the transverse conveying means 5 reaches the dehydration screen 61 and increases the water level abnormally, the water level sensor 64 detects this and controls the conveying motor M2 so that the vertical conveying screw 62 positively rotates. When the vertical conveying screw 62 positively rotates, the leading edge of the vertical conveying screw 62 makes sliding contact with the inner circumferential surface of the dehydration screen 61 and thus can clear the clogging, so that water can be quickly drained to the outside of the dehydration screen 61 through the unclogged dehydration holes 61*a*.

On the other hand, in the case where shredded garbage becomes jammed between the dehydration screen 61 and the vertical conveying screw 62, control is performed so that the conveying motor M2 is negatively rotated to remove the jammed garbage and then again positively rotated to convey the shredded garbage upward.

It should be noted that a chute 9 having an inlet at one end and an outlet at the other end, the inlet facing the outlet 6*b* of the dehydration screen 61 and the outlet opposing a feed opening 7*a* of the drying means 7, is coupled to the main body casing 2. Then, a flap 91 (see FIG. 4) facing the outlet 6*b* of the dehydration screen 61 is axially supported by the chute 9 so as to be able to swing on a vertical axis. This flap 91 is biased to a position at which it closes the outlet 6*b* of the dehydration screen 61 by a biasing force of a spring that is not shown. Then, as described above, when shredded garbage has been conveyed upward by the vertical conveying screw 62 and a certain amount or more of the shredded garbage has been forcibly pushed out through the outlet 6*b* of the dehydration screen 61 toward a leading edge side of the flap 91 by the protruding portion 631, the flap 91 swings from the position at which it closes the outlet 6*b* to a position at which it opens the outlet against the biasing force of the spring. Accordingly, a constant amount of shredded garbage can be reliably supplied via the chute 9 to a downstream stage, that is, the drying means 7 each time.

The drying means 7 includes a feed opening member 71 having an approximately major arc cross-sectional shape that faces upward toward the outlet on the other end of the chute 9, drying drums 72 respectively fitted into left and right end portions of the feed opening member 71 in a rotatable manner, a stirring motor M3 for rotating the left and right drying drums 72, and a sheath heater 73 extended between the left and right drying drums 72, and when the stirring motor M3 rotates, the left and right drying drums 72 rotate together with the sheath heater 73 relative to the feed opening member 71.

Here, the left and right drying drums 72 include a drum main body 721 made of a material in which a plurality of small holes 72*a* are formed, such as perforated metal, by forming the material into a tubular shape and a closure plate 722 for closing an opening at one end of the drum main body 721. A coupling member (not shown) and a stirring member 74 (see FIG. 5) are installed between the closure plates 722 of the left and right drying drums 72, and the sheath heater 73 bent into a U-shape is extended therebetween. Accordingly, when the drying drums 72 are rotated relative to the feed opening member 71 by the stirring motor M3, the sheath heater 73 and the stirring member 74 also rotate, thereby stirring and heating shredded garbage.

Furthermore, the main body casing 2 is provided with the exhaust fan 8, by which external air can be sucked into the main body casing 2 and can be exhausted together with internal air in the main body casing 2 to the outdoors through an exhaust pipe P2 (see FIG. 2) coupled to an exhaust opening formed in the main body casing 2 by forcing a check valve 81 open.

It should be noted that the garbage disposal apparatus 1 of this embodiment is formed into a compact size so as to allow installation under a kitchen sink S for household or commercial use. Specifically, the external dimensions are W 320 mm×H 400×D 380 mm.

Next, a procedure by which garbage is disposed of by the thus configured garbage disposal apparatus 1 will be described. In a household or the like, garbage that has been generated during cooking or the like is put into the garbage disposal apparatus 1 through the drain opening Sa of the sink S, and thereafter the garbage strainer 34 is fitted to the tube 32 of the connecting member 3 through the drain opening Sa. This causes the shredding motor M1, the conveying motor M2, and the stirring motor M3 to be rotatively driven for a set period of time by means of timer control, and the sheath heater 73 to operate for a set period of time.

First, when the shredding motor M1 is rotatively driven, the shredding blades 46 positively rotate in opposite directions, and garbage that has dropped down through the connecting member 3 and remains between adjacent shredding blades 46 is sheared and shredded into small pieces by the cutting teeth of the opposing shredding blades 46, and drops into the transverse conveying means 5. At this time, in conjunction with the rotation of the shredding blades 46, the retaining blade 41 also rotates thereabove, so that garbage that has dropped onto the shredding blades 46 can also be pressed down from above. Therefore, root crops such as radish and fruits such as apples are prevented from jumping around on the shredding blades 46 and thus can be reliably shredded.

It should be noted that the shredder 44 is capable of shredding even big bones of fish and the like, crab shells, and shellfish shells, which conventionally are difficult for some disposers to grind, and also shredding even disposable wooden chopsticks, small branches of ornamental plants, and the like that are put in accidentally.

Garbage that has been shredded into small pieces by the shredding means 4 drops downward and is conveyed on the conveying trough 51 in a horizontal direction toward the dehydrating means 6 by the transverse conveying screw 52 of the transverse conveying means 5 that similarly is rotatively driven via the shredding motor M1.

In this manner, garbage that has been put in from the drain opening Sa of the sink S drops down under its own weight and is shredded by the shredding means 4 and thereafter forcibly conveyed to the dehydrating means 6 by the transverse conveying means 5, so that unlike conventional disposers, tap water is not necessary during grinding and conveyance of garbage, and thus the consumption of tap water is not increased. Moreover, even if kitchen work is performed in the sink S in a state in which garbage is being shredded, the drain water is drained to the outside through the drainage holes 51*a* of the conveying trough 51 when it runs down into the transverse conveying means 5 via the shredding means 4, and therefore kitchen work is in no way restricted.

Once shredded garbage is introduced into the dehydrating means 6 through the inlet 6*a* of the dehydration screen 61 of the dehydrating means 6 by the transverse conveying means 5, the vertical conveying screw 62 that is positively rotated by the conveying motor M2 being driven to positively rotate conveys the shredded garbage upward, and excess water contained in the garbage is removed by the dehydrating effect due to compression and drained through the dehydration holes 61*a* of the dehydration screen 61. Then, the shredded garbage that has been conveyed to the upper end by the rotating vertical conveying screw 62 is forcibly pushed out through the outlet 6*b* of the dehydration screen 61 by the protruding portion 631 provided at the upper end portion of the rotating shaft 63. The shredded garbage pushed out of the outlet 6*b* of the dehydration screen 61 acts on the leading edge of the flap 91 of the chute 9, and the flap 91, upon receiving a certain amount of pressing force, swings against the biasing force of the spring to open the outlet 6*b*.

The shredded garbage is pushed out in a sequential manner through the flap 91 that has been pushed open, and then fed into the drying means 7 from the chute 9 via the feed opening 7*a*. The shredded garbage fed into the drying means 7 is stirred by the stirring member 74 and the sheath heater 73 provided for the drying drums 72 that are rotated by the stirring motor M3 being rotatively driven. At this time, since the sheath heater 73 is heated to a set temperature, for example, a temperature that prevents even dried garbage that comes into contact with the heater from burning and sticking thereto, the shredded garbage being stirred by the rotation of the stirring member 74 and the sheath heater 73 in conjunction with the drying drums 72 is brought into contact with and heated by the sheath heater 73, and thus loses its moisture by evaporation and is dried. This results in a reduction in the volume of the shredded garbage. Since the shredded garbage is dried and reduced in volume, the shredded garbage can pass through the small holes 72*a* of the drying drums 72 and is thus collected in the garbage receptacle B.

Specifically, garbage is shredded into pieces about 1 cm square by the shredding means 4 and thereafter reduced in volume to about 5 mm square, so that the volume of the garbage is reduced to anywhere from one-tenth to one-twentieth of its original volume depending on the type of garbage. Thus, assuming that the garbage receptacle B has an effective capacity of 6 liters and an average of 700 g of garbage a day is disposed of, it is necessary to discard dried garbage collected in the garbage receptacle B only about once a month.

It should be noted that although not shown in detail in the drawings, a fullness sensor 75 (see FIG. 2) is provided so as to be able to move up and down via a cam that rotates in conjunction with the rotation of the drying drums 72, and a state in which a certain amount of volume-reduced dried garbage has accumulated in the garbage receptacle B can be detected. When the fullness sensor 75 has detected fullness of the garbage receptacle B, the operation of the garbage disposal apparatus 1 is suspended, and a notification that the shredded garbage that has accumulated in the garbage receptacle B should be discarded is provided.

Meanwhile, the exhaust fan 6 continuously operates and can prevent odors from spreading by sucking water vapor, odors, and the like building up inside the main body casing 2 together with external air and exhausting them to the outside by forcing the check valve 81 open.

The present invention may be embodied in various other forms without departing from the spirit or essential characteristics thereof. Accordingly, the above-described embodiment is to be considered in all respects as illustrative and not limiting. The scope of the invention is indicated by the appended claims rather than by the foregoing description. Furthermore, all variations and modifications falling within the meaning and range of equivalency of the appended claims are intended to be embraced within the scope of the invention.

The present invention is beneficial to an industry in which the disposal of garbage is necessary, in that the volume of garbage can be significantly reduced and the cost of discarding garbage can be reduced, and also can contribute to resource-saving because tap water is not necessary.

The invention claimed is:

1. A garbage disposal apparatus comprising:

a shredding device configured to communicate with a drain opening of a sink via a connecting member, and being configured to shred garbage put in through the drain opening of the sink and the connecting member;

a transverse conveying device disposed under the shredding device, and being configured to convey the shredded garbage in a transverse direction;

a dehydrating device disposed adjacent to the transverse conveying device and into which the shredded garbage conveyed through the transverse conveying device is introduced, and being configured to dehydrate the shredded garbage while conveying the shredded garbage upward;

a drying device disposed adjacent to the dehydrating device and into which the shredded garbage discharged through the dehydrating device is supplied via a chute, and being configured to dry the shredded garbage while rotating so as to reduce the volume of the shredded cabbage;

a garbage receptacle disposed under the drying device so as to be able to be pulled out, and into which the shredded garbage dried and reduced in volume by the drying device is configured to be dropped from the drying device and collected; and a garbage strainer that is detachably disposed in the connecting member and doubles as a starting switch through the drain opening of the sink, wherein the dehydrating device, the drying device, and the garbage receptacle are disposed in a main body casing, the shredding device and the transverse conveying device are disposed in a side casing fixed to the main body casing, and the connecting member is coupled to the side casing, wherein the shredding device comprises a shredder and a retaining blade, the shredder having two parallel rotating shafts which are configured to rotate in opposite directions to each other and which are axially supported by the casing in a rotatable manner, and each of the rotating shafts has a plurality of shredding blades, and the retaining blade is disposed above the shredder, has a rotating shaft which is axially supported by the side casing in a rotatable manner, and is configured to press down garbage from above, wherein the transverse conveying device comprises an approximately semi-cylindrical conveying trough having a plurality of drainage holes formed in a peripheral wall thereof, transverse conveying screw disposed in the conveying trough, and a rotating shaft which is axially supported by the side casing in a rotatable manner, wherein the rotating shaft of the transverse conveying device, the rotating shafts of the shredder, and the rotating shaft of the retaining blade are configured to be rotated in this order in set directions by a single shredding motor in conjunction with one another, at a reduced speed with respect to the number of revolutions of the shredding motor, and wherein the retaining blade is configured to be driven at a reduced speed while the shredding motor is driven so as to be able to feed garbage into the shredder continuously.

2. The garbage disposal apparatus according to claim 1, wherein the dehydrating device includes a water level sensor for detecting that a water level in a dehydration screen has risen to a certain level or more.

3. The garbage disposal apparatus according to claim 1, wherein a flap facing an outlet of the dehydrating device is disposed in the chute so as to be able to swing on a vertical axis, and the flap is biased by a spring so as to close the outlet.

4. The garbage disposal apparatus according to claim 1, further comprising a fullness sensor for detecting that the garbage receptacle in which the dried shredded garbage is sequentially collected is full to capacity.

5. The garbage disposal apparatus according to claim 1, wherein an exhaust fan is attached to a main body casing housing the dehydrating device, the drying device, and the garbage receptacle.

6. The garbage disposal apparatus according to claim 1, further comprising a gear fixed to an output shaft of the shredding motor, a gear fixed to the rotating shaft of the transverse conveying screw, gears respectively fixed to the rotating shafts of the shredder, and a gear fixed to the rotating shaft of the retaining blade, wherein the gears are engaged with each other successively or via a reduction gear.

* * * * *